US005118004A

United States Patent [19]

Carilli

[11] Patent Number: 5,118,004

[45] Date of Patent: Jun. 2, 1992

[54] DOUBLE CONTAINMENT SYSTEM FOR LIQUID HAZARDOUS MATERIAL

[75] Inventor: Brian D. Carilli, Palo Alto, Calif.

[73] Assignee: The Board of Trustees of the Leland Stanford Junior University, Stanford, Calif.

[21] Appl. No.: 295,659

[22] Filed: Jan. 9, 1989

[51] Int. Cl.[5] ..... B65D 90/24; B65D 1/24

[52] U.S. Cl. ..... 220/408; 220/571; 206/45; 206/558; 211/88; 211/126; 108/24

[58] Field of Search ..... 108/24; 211/88, 127, 211/62, 63; 220/18, 1 C; 206/45, 558, 564

[56] References Cited

U.S. PATENT DOCUMENTS

| | | | |
|---|---|---|---|
| 606,842 | 7/1898 | Miller | 108/24 |
| 997,361 | 7/1911 | Atlee | 220/18 |
| 1,420,061 | 6/1922 | Rappeline | 108/24 |
| 1,807,589 | 6/1931 | Edmunds | 220/18 |
| 1,863,471 | 6/1932 | Colaizzi | 211/88 |
| 2,486,932 | 11/1949 | Elliott | 220/18 |
| 3,331,524 | 7/1967 | Wiley | 220/18 |
| 3,643,812 | 2/1972 | Mander | 206/558 |
| 3,920,144 | 11/1975 | Callen | 220/1 C |
| 4,245,748 | 1/1981 | Kvamsdal | 220/1 C |
| 4,392,552 | 7/1983 | Partridge | 220/1 C |
| 4,823,947 | 4/1989 | Maynard | 220/1 C |

*Primary Examiner*—Stephen Marcus
*Assistant Examiner*—S. Castellano
*Attorney, Agent, or Firm*—Flehr, Hohbach, Test, Albritton & Herbert

[57] ABSTRACT

A double containment device for liquid hazardous material wherein a first liquid hazardous material container may be placed on a shelf having a second liquid hazardous material container, which meets statutory volume requirements, thereunder. The second container being located directly underneath the first container and collecting, through a support plate, any liquid hazardous material from the first container. Also disclosed is a tray in which a first container would rest. Spills from this first container seep on to the tray and are channelled through a drainage path to a second container, again fulfilling statutory volume requirements; the tray, drainage path and second container clipping on to the existing shelf.

1 Claim, 2 Drawing Sheets

DOUBLE CONTAINMENT SYSTEM FOR LIQUID HAZARDOUS MATERIAL

BACKGROUND OF THE INVENTION

1. Field of the Invention

The present invention relates generally to storage of hazardous materials. More specifically, the present invention relates to the storage of liquid hazardous material in double containment devices.

2. Description of the Prior Art

Liquid hazardous materials have become commonplace in our society. They can be seen as pesticides in our hardware stores, used motor oil in our garages and in various forms in our manufacturing and research facilities. Seepage from these and other sources pose a significant health risk. Local and national agencies have begun regulating these materials as a result. This regulation will continually be expanded and increased Currently, in a significant number of jurisdictions, the law regarding regulation of these materials calls for storage in a double containment device. The current practice is to store these materials in a simple tray having sides. The trays are placed on shelves where they can be readily accessed by the researcher in the laboratory or the customer in the hardware store, etc. The bottle in which the substance is stored is the first container, the tray is the second container, thus fulfilling a double container storage requirement.

Recent changes in codes and regulations provide that any container that holds liquid hazardous material (CLHM) is now required to be stored in a secondary container that will hold 150% of the volume of the hazardous material. These new codes allow storage of more than one container of hazardous material in one secondary container, as long as the secondary container can hold (1) 150% of the largest CLHM volume or (2) 10% of the aggregate volume being stored.

In the first case, a large container can be placed in a tray (which is 150% of the container's volume) and any portion of the tray left available may be filled with as many smaller containers as will fit. In the second case, if 10 one pint bottles are to be stored in a tray, the tray which is the second container must have a volume of at least 1 pint.

The method now used for storing chemicals precludes the use of one double containment devise per CLHM, due to the loss of storage space. Storing more than one CLHM per tray, however, results in another problem: the reduction in the volume of the secondary containment device (the tray) by the displacement volume of each bottle added, i.e , only the spaces between the CLHMs could contain the spills.

Thus, the greater the number of bottles stored in a tray (the greater the efficiency), the less volume that can be stored because of the reduction in second container volume. Also, this flux of second container volume makes it difficult to readily ascertain or calculate the volume of the second container.

There are additional shortcomings to the present system of storage. One is that of "floaters," a half full bottle of chemical placed in the tray which floats during a spill. For example, when there is a spill from another bottle in the same tray the half full bottle may float up and possibly fall over the side. Its impact with the floor could cause a hazardous spill. Another shortcoming is the inefficient use of storage space. Particularly, the volume of the shelf itself could more efficiently be used for liquid hazardous material storage. Furthermore, the high walled trays obscure the view of a bottle's contents label making it difficult and time consuming to locate a particular bottle.

Additional shortcomings of prior art methods now prevalently in use include poor earthquake survival potential, difficult accessibility for clean-up, and difficult regulation enforcement due to inconsistent and often overused storage methods.

SUMMARY OF THE INVENTION

Accordingly, it is an object of this invention to provide a double containment device for storage of liquid hazardous material that maximizes storage efficiency without compromising on safety.

It is another object of the invention to provide a double containment device as above which can readily be integrated into existing facilities.

It is another object of the invention to provide a double containment device that is earthquake safe.

It is another object of the invention to provide a double containment device from which a spill may be easily cleaned.

It is another object of the present invention to provide a double containment device where the labels of the chemicals stored therein could be readily identified.

It is still another object of the present invention to provide a double containment device which fosters consistent regulation of liquid hazardous material storage.

The attainment of these and related objects may be achieved through use of the novel double containment device for liquid hazardous material herein disclosed. A double containment device for liquid hazardous material in accordance with this invention has a first storage means for storing hazardous material with liquid properties.

Located underneath the first storing means is a second storage means for storing hazardous material with liquid properties. A means for passing spilled hazardous material from the first storage means into the second storage means is further provided Preferably, a means for containing spilled hazardous material such that they spill only into the second storage means surrounds the passing means. Lastly, a means for supporting the double containment device is typically provided The attainment of the foregoing and related objects, advantages and features of the invention should be more readily apparent to those skilled in the art, after review of the following more detailed description of the invention, taken together with the drawings, in which:

DETAILED DESCRIPTION OF THE INVENTION

Figure 5:
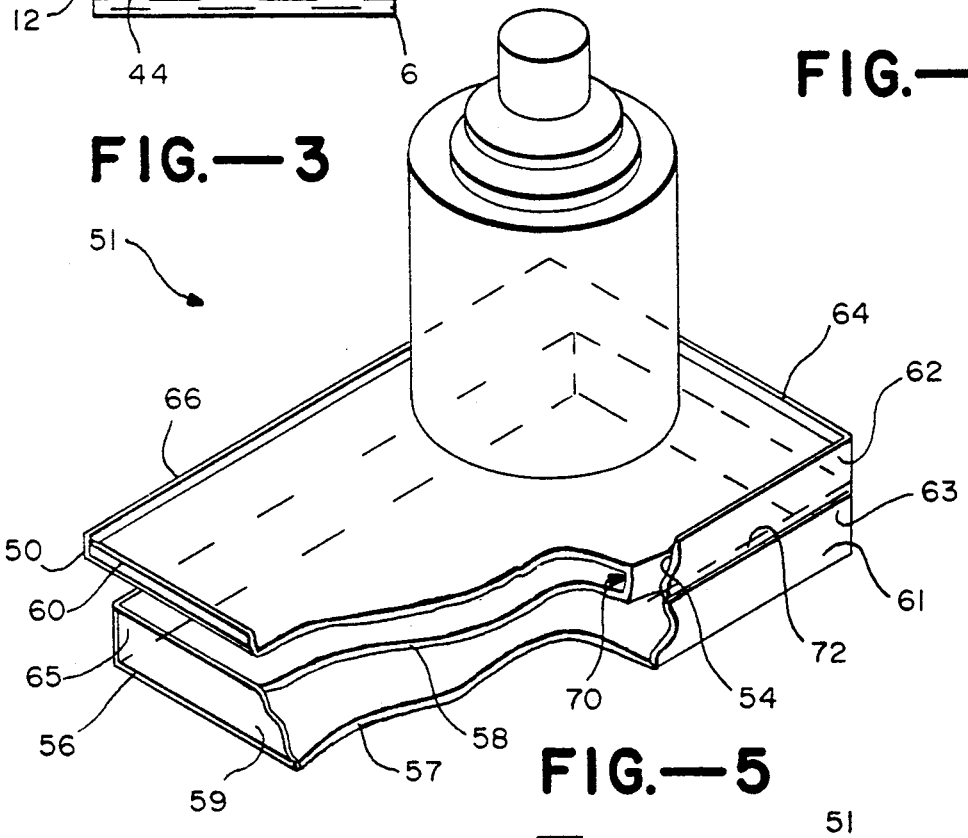
FIG. 5 is a perspective view of an alternative embodiment of the preferred embodiment wherein the double containment device may be attached to an existing shelf.
Figure 6:
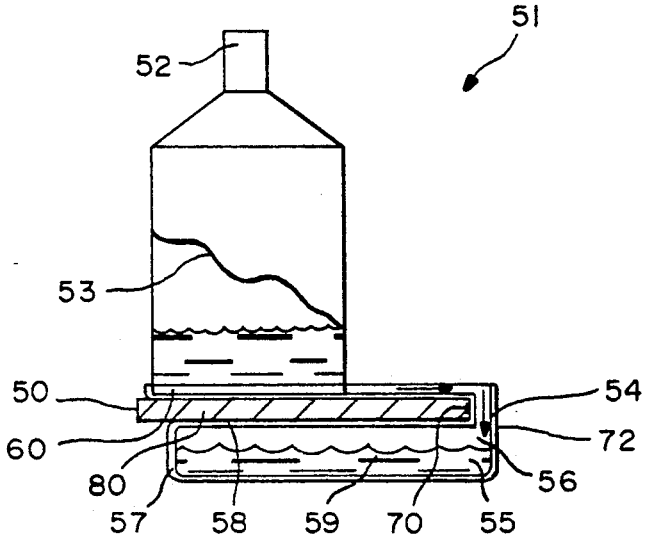
FIG. 6 is a side sectional view of an alternative embodiment of the preferred embodiment.

Turning now to the drawings, two embodiments are represented. The first, illustrated in FIGS. 1-4, is the double container device or apparatus 1 for liquid hazardous material as it would be installed at an initial setup. The second, illustrated in FIGS. 5-6, is a design for installing the double containment device or apparatus 51 for liquid hazardous material at a location which already has shelves constructed, i.e., the double containment device fits onto the shelf itself.

Figure 1:
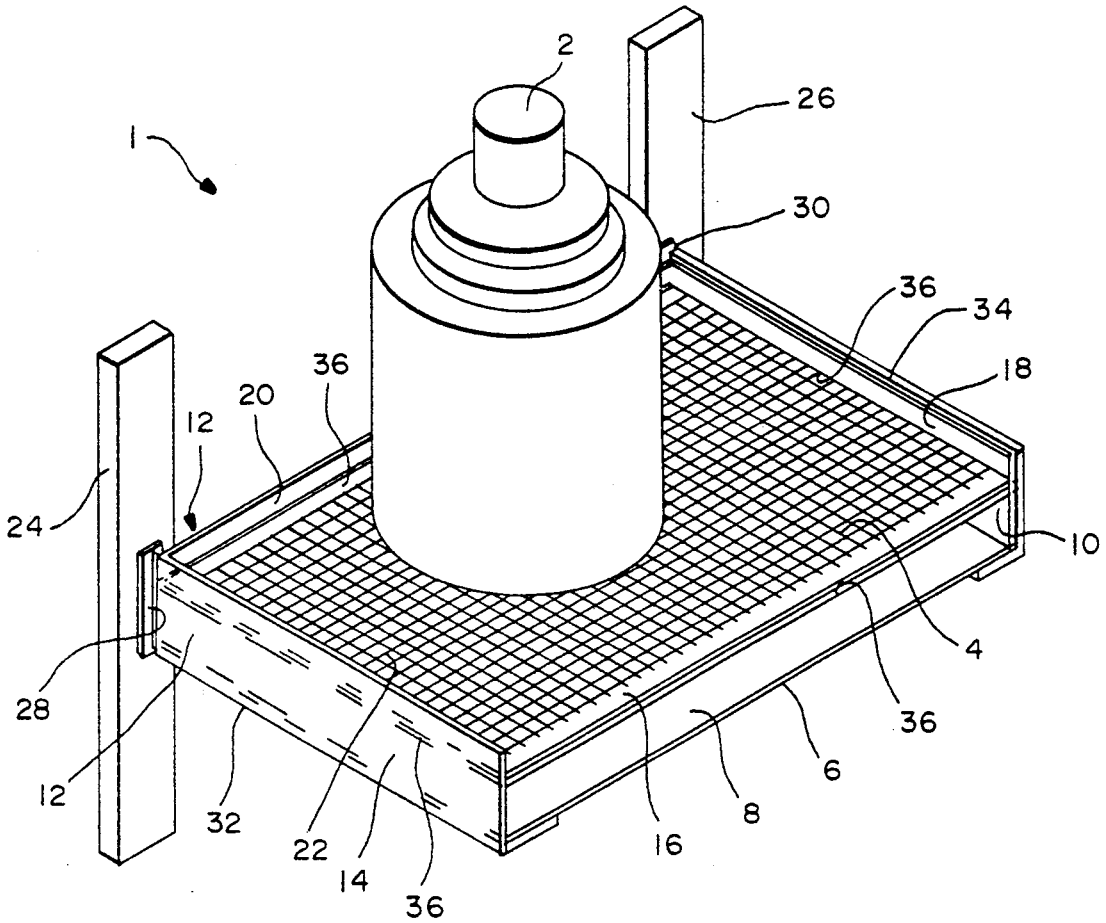
FIG. 1 is a perspective view of a double containment apparatus according to the preferred embodiment.

Referring to FIG. 1, a first container 2 is placed on a perforated grate 4. Liquid hazardous material from the first container 2 can pass through the grate 4 into the second container 6, or tray 6. The grate 4, the second container or tray 6, and all other components of the double containment device for liquid hazardous material are made of a suitable non-destructible material. Thus, the material used in construction of the devices 1 and 51 may vary with the specific chemical sought to be stored. The material used to construct the first container 2, however, is solely within the discretion of the user.

The tray 6 holds the grate 4 between its two sets of walls, an upper and a lower. The lower wall is comprised of four connected segments: front 8, right side 10, back 12 and left side 14. The upper wall is comprised of four segments also. They are the front 16, right side 18, back 20 and left side 22.

A lip is defined between the upper and lower walls. The grate 4 is located at this lip 36. It may either rest on the lip 36 or be physically attached to it. The upper connected walls 16-22 are approximately ½ inch high and surround the grate. This is high enough to contain any viscous liquid. It also is above the minimum height requirement to retain the first container 2 during an earthquake.

The upper connected walls 16-22 have the extra advantage, however, that they are still low enough that labels on the bottles stored on the shelf can be easily read. This is a vast improvement over the prior art volume to meet legal requirements, but which obstructed the view of the labels. In that case a person would have to lift the tray off the shelf and then examine its contents by lifting out each bottle, a needlessly lengthy process.

The lower connecting walls 8-14 are approximately 1 and ¾ inches high. This height provides necessary volume within the tray 6. The tray 6 has a horizontal area which is greater than that of the first container 2. This assures that any liquid spilt from the first container 2 will be directed through the grate 4 to the tray 6 by the force of gravity The tray 6 is held in place by horizontal supports 32 and 34, brackets 28 and 30 and vertical supports 24 and 26. The horizontal support 32 attaches to the bracket 28 which in turn attaches to the vertical support 24. The horizontal support 34 attaches to the bracket 30 which in turn attaches to the vertical support 26. The horizontal supports 32 and 34 are attached to opposite sides of the tray 6. In this embodiment the volume that would ordinarily be taken up by a shelf can be used for storage.

The device 1 in this embodiment prevents half full bottles (floaters) from floating in spilled liquid because the grate 4 supports the first container 2 safely away from any spilled liquid.

Figure 2:
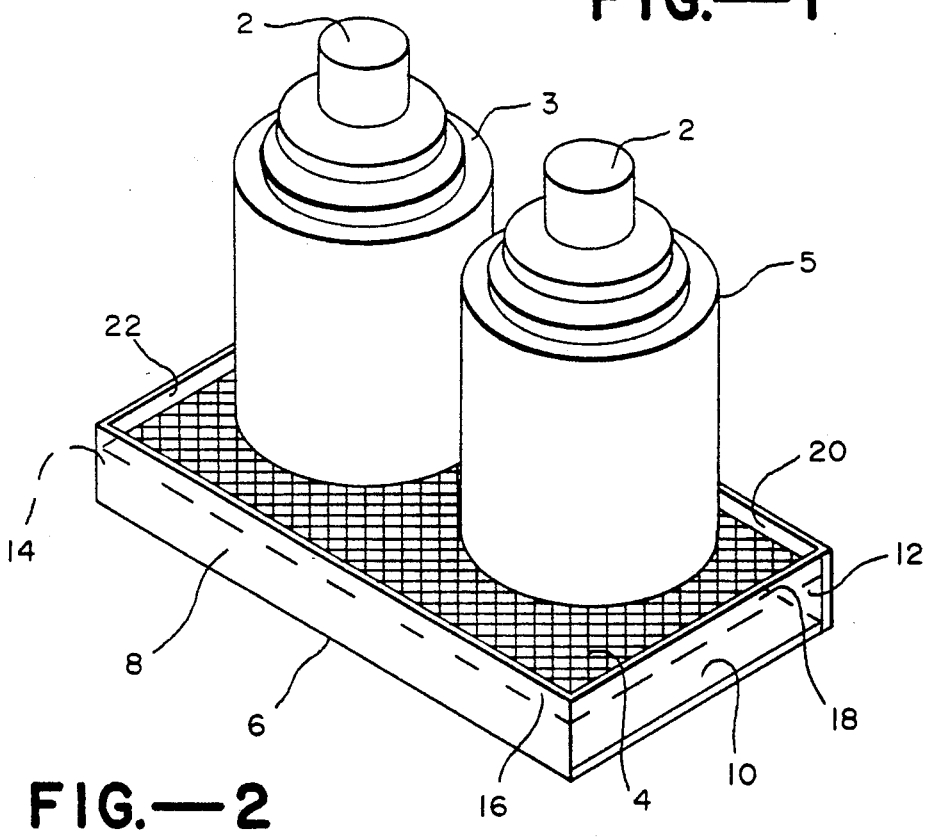
FIG. 2 is a perspective view of a double containment apparatus tray with a pair of containers seated thereon according to the preferred embodiment
Figure 3:
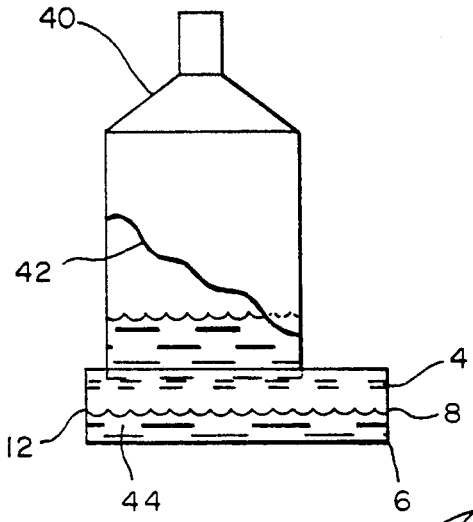
FIG. 3 is a side sectional view of the double containment apparatus according to the preferred embodiment.

Referring to FIG. 2, the first container 2 includes two vials 3 and 5. The vials 3 and 5 rest on the grate 4. FIG. 2 isolates on the containment tray 6 itself without the horizontal and vertical supports demonstrated in FIG. 1. The tray 6 is comprised of lower walls 8-14 and upper walls 16-22. The separation between these portions is represented by the dashed line or the most vertical portion of the grate 6, whichever is more appropriate Referring to FIG. 3, a side sectional view of the preferred embodiment is presented A first container 40 is represented with a crack 42 in it. This side view shows how any spilled liquid 44 from the first container 40 flows through the perforated grate 4 into the tray 6 which acts as a second containment device.

Figure 4:
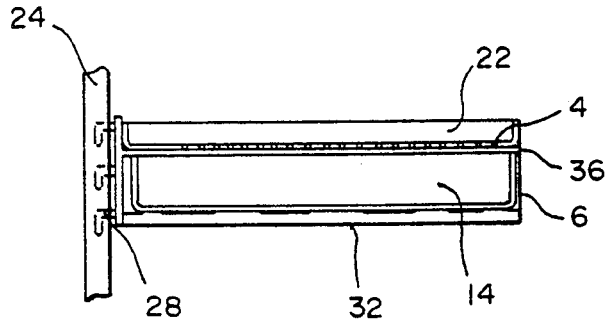
FIG. 4 is a side sectional view of a shelf bracket according to the preferred embodiment.

Referring to FIG. 4, a side view of the tray 6 and the support apparatus of the preferred embodiment is shown. The horizontal support 32, shown transparently, is connected to the shelf bracket 28 The shelf bracket 28 attaches the horizontal support 32, and the tray 6 attached thereto, to the vertical support 24. Upper wall 22 is shown transparently. Below it is the perforated grate 4 held in place by the lip 36. The horizontal surface area enclosed by the upper walls and lip 36 are slightly larger than that of the lower walls, maintaining the position of the grate 4 at the lip 36.

The tray 6 rests on the horizontal support 32 and the other horizontal support 34 (not shown because of the perspective). By resting on the horizontal supports 32 and 34 the tray 6 may be pulled out easily. This is advantageous for transportation of chemicals from storage to or from a lab station. Also, cleaning is enhanced by the snap out nature of the tray 6 and brackets 28 and 30.

Ordinary wood or particle board shelves have a thickness of approximately ¾ of an inch, and may approach one inch. The preferred embodiment produces more efficient storage. The volume that would ordinarily be taken up by a thick shelf is instead used to hold a volume of chemical.

Turning now to FIG. 5, an alternate embodiment of the double containment device for liquid hazardous material is shown. The embodiment in FIG. 5 is to be used primarily to fit over pre-existing shelving. A tray 50 has a flat horizontal surface, which may have a gentle slope or be wholly horizontal. A first container 52 is placed on this tray 50. Spillage from the first container 52 flows through a drainage opening 54 into a second container 56. The second container 56 has a bottom 57 and a top 58.

Between the tray 50 and the second container 56 is an open space defined by the inside wall 70 of the drainage opening 54 and the practically parallel top of the second container 58 and the bottom of the tray 50. In this configuration the double containment device 51 is mounted to a shelf (80 in FIG. 6). The second container 56 has four connected walls 59-65. The height of these walls 59-65 can vary depending on the desired volume of the second container 56.

The tray 50 has four connected walls 60-66. These walls 60-66 serve to retain any liquid within the tray and provide stability for first containers 52 during an earthquake. Moving vertically downward, the front wall 62 of the tray 50 is connected to the outside wall 72 of the drainage opening 54 which in turn is connected to front wall 61 of the second container 56.

Referring to FIG. 6, a side sectional view of the alternate preferred embodiment is presented. The first container 52 rests on the tray 50 (in the same fashion that first container 2 rests on the perforated grate 4 in FIG. 1). Spillage from container 52 may be caused by a crack 53. Spilt liquid hazardous material would flow, by the force of gravity, through the drainage opening 54 to the second container 56. As demonstrated in FIG. 6, this configuration 51 is designed to fit around an existing shelf 80 and be supported thereby. It allows for easy conversion from conventional shelves to shelves which can efficiently store liquid hazardous material in safe double containment configuration.

The bottom of the tray 50, the inside wall 70 of the drainage opening 54 and the top 58 of the second container 56 form the portion of the device which clips on securely to the shelf. The vertical length of the drainage opening can be modified so that the device 51 may fit on shelves of varying thicknesses.

This configuration 51 provides all the advantages, i.e., cleaning, etc., which applied to the device 1 of FIG. 1, except it is, perhaps, not as suitable for transportation of chemicals to a work station. The exception is due to the lack of support for the first container 52 because of the opening which fits onto the shelf 80 provides no support. A very heavy first container could stress the drainage opening. This problem would be eliminated by using a strong enough material to compensate for the weight of the first container Another advantage to this system is that it will foster enforcement of hazardous material regulation by providing a uniform storage method that is easily implemented and not a burden financially. Enforcement is also enhanced because the volume of the secondary containers, the trays 6 and 56, is fixed and readily ascertainable, regardless of what the volume of the first container is. Contrarily, the volume of trays commonly used today continually fluctuate as the number and size of vials placed in them varies.

It should further be apparent to those skilled in the art that various changes in form and details of the invention as shown and described may be made. It is intended that such changes be included within the spirit and scope of the claims appended hereto.

What is claimed is:

1. An integral shelf and spill containment apparatus for safely storing at least one container for hazardous material having primarily liquid properties, comprising:

horizontal tray means for supporting the bottom of said container, said tray means having a plurality of interconnected wall segments rising vertically from the perimeter thereof;

said plurality of wall segments being of a height that is sufficient both to retain split material from said container and to permit easy inspection of a label on said container;

collection means for collecting split material from said container in a confined area separated from said container such that said collection means retains substantially all the split material away from said container, said collection means being substantially horizontal in dimension and having a significantly smaller vertical dimension than horizontal dimension; and drainage means connected between said horizontal tray means and said collection means such that, when material spills from said container to said tray means, said material passes through said drainage means into said collection means;

said apparatus having a configuration for installation on to a horizontal shelf having a top, front and bottom portion; said tray means resting on said top portion, said drainage means being adjacent to said front portion; and said collection means being under said bottom portion, so that said apparatus is secured to said horizontal shelf by wrapping around said top, front and bottom portions thereof.

* * * * *